US005695369A

United States Patent [19]

Swenson, Sr.

[11] Patent Number: 5,695,369

[45] Date of Patent: Dec. 9, 1997

[54] QUICK MULTIPLE CONNECT ELECTRICAL CONNECTOR

[76] Inventor: Roger M. Swenson, Sr., Rt. #2, Box 49A, Williamsville, Mo. 63967

[21] Appl. No.: 720,912

[22] Filed: Oct. 3, 1996

[51] Int. Cl.[6] ..... H01R 11/09

[52] U.S. Cl. ..... 439/784; 439/428; 439/805

[58] Field of Search ..... 439/784, 805, 439/727, 428, 937

[56] References Cited

U.S. PATENT DOCUMENTS

| | | | |
|---|---|---|---|
| 1,039,542 | 9/1912 | Kennington | 439/805 |
| 1,649,923 | 11/1927 | Post | 439/807 |
| 2,056,248 | 10/1936 | Buchanan | 439/784 |
| 2,724,097 | 11/1955 | Matthysse | 439/805 |
| 4,944,699 | 7/1990 | Velke, Sr. et al. | 439/784 |
| 5,018,251 | 5/1991 | Brown | 24/136 R |
| 5,228,875 | 7/1993 | Swenson, Sr. | 439/784 |

FOREIGN PATENT DOCUMENTS

| | | | |
|---|---|---|---|
| 26368 | 6/1923 | France | 439/428 |
| 846809 | 9/1939 | France | 439/428 |
| 910390 | 6/1946 | France | 174/845 |
| 237857 | 9/1945 | Switzerland | 439/427 |
| 879864 | 10/1961 | United Kingdom | 439/427 |

*Primary Examiner*—Neil Abrams
*Assistant Examiner*—T. C. Patel
*Attorney, Agent, or Firm*—Jim Zegeer, Esq.

[57] ABSTRACT

A quick connect electrical connector for connecting the bare ends of a pair of electrical wires. It comprises a non-conductive first coupling member, having a plurality of connection chambers, each connection chamber having a threaded wall and a central axis. A common conductive connector member is fixedly mounted in the coupling member and having a plurality of bullet-shaped ends, one in each connection chamber with the end surfaces of the coupling member tapering inwardly to a tip. A corresponding plurality of non-conductive second coupling members having an externally threaded wall and internal throughbore having first and second ends and a first conically shaped annular wall surface. The first conically shaped surface and the bullet-shaped connector portions are spaced a variable distance apart when the threaded surfaces are engaged.

6 Claims, 5 Drawing Sheets

QUICK MULTIPLE CONNECT ELECTRICAL CONNECTOR

BACKGROUND AND BRIEF DESCRIPTION OF THE INVENTION

The present invention is an improvement on the quick connect electrical connector disclosed in my U.S. Pat. No. 5,228,875 issued Jul. 20, 1993. In my U.S. Pat. No. 5,228,875, I disclose a quick blind connect electrical connector for the bare end of electrical wires in which there is one connection chamber for making blind electrical connections.

An object of the present invention is to provide a device of the character disclosed in my U.S. Pat. No. 5,228,875 in which dual or multiple blind connection chambers are provided. In a preferred embodiment of the present invention, a bullet-shape ended conductive member is fixedly secured in the central portion of a non-conductive female coupling dividing the non-conductive female coupling member into two or more connection chambers, one connection chamber for each wire end. The internal walls of the connection chambers are threaded so that each connection chamber threadably receives a non-conductive male coupling member. Each male coupling member has a bore therethrough which is shaped and configured similar to the bore and shaping of the non-conductive male coupling members disclosed in my above-mentioned patent for guiding the wire ends and clamping the wire ends to a common electrical conductor. The non-conductive male coupling member has a first end having a conically-shaped annular wall which is complementary to the conically-shaped or bullet end surface of a conductive metal connector member. The conically-shaped surfaces on the male coupling member and the metal connector member are spaced a distance apart to receive the wire end so that when the bare end wire is inserted into the bore, it is first guided to the center of the throughbore and then off axis by the conically-shaped end surface of the metal connector and positioned between the spaced conical surfaces and rotation of one of the members relative to the other engages threads to reduce the distance and clamp the bare end of the wire between the conical surfaces.

Thus, the object of the invention is to provide an improved blind electrical connector for multiple wires which is low in cost, easy to manufacture and use and requires no tools.

DESCRIPTION OF THE DRAWINGS

The above and other objects, advantages and features of the invention will become more apparent when considered with the following specification and accompanying drawings, wherein.

DETAILED DESCRIPTION OF THE INVENTION

Figure 1:
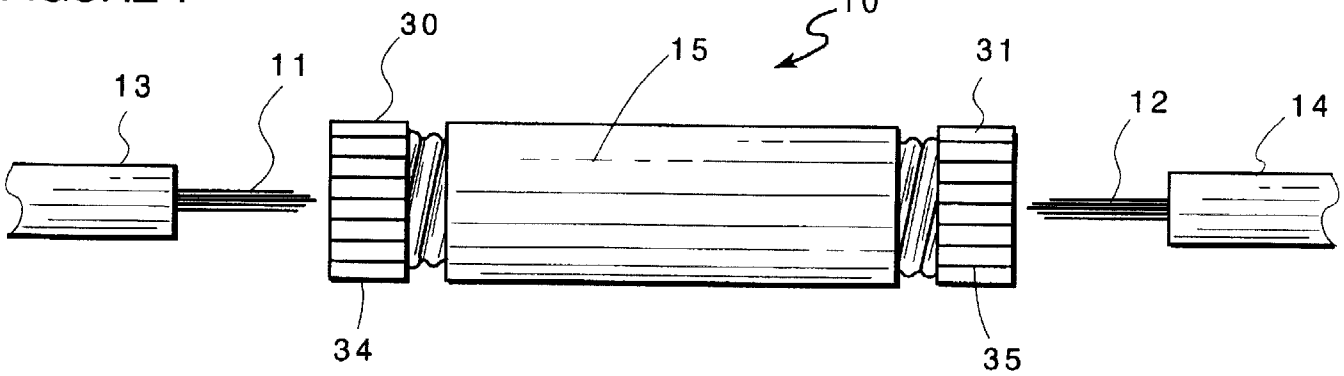
FIG. 1 is an external view of the invention showing the wires about to be inserted so that an electrical connection can be made therebetween and resulting in an insulated coupling of two wires.
Figure 2:
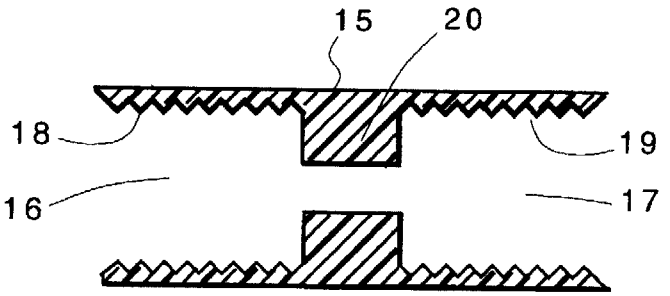
FIG. 2 is a sectional view of the female non-conductive member forming the housing for the two connection chambers of the present invention.
Figure 3:
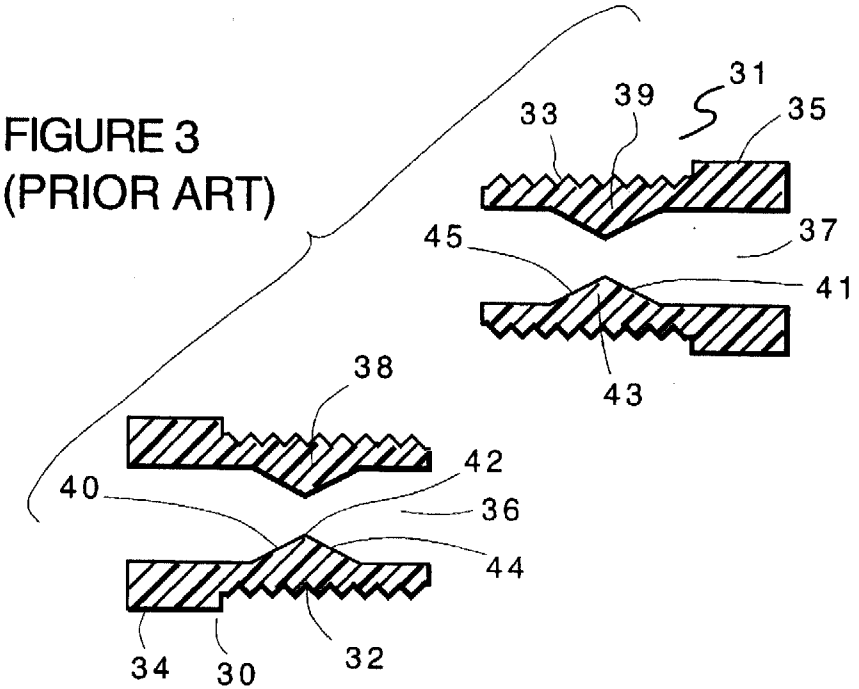
FIGURE 3 (PRIOR ART)
FIG. 3 is a sectional view of first and second male coupling members having interior configurations similar to those disclosed in my aforementioned U.S. Pat. No. 5,228,875.
Figure 4:
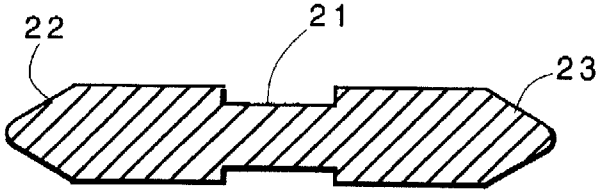
FIG. 4 is a sectional view of the interior metal connector component incorporated in the invention.

Referring to FIG. 1, an electrical connector 10 for connecting the bare ends 11, 12 of a pair of wires 13 and 14, respectively. It includes an non-conductive first coupling member which may be circular, square, triangular or any other configuration. Non-conductive first coupling member 15 forms a housing for connection chambers 16 and 17 (see FIG. 2). Each of the connecting chambers have internally threaded walls 18 and 19, respectively, and a partition member 20 which mounts or secures a common metal connector member 21. The metal connector member 21 is fixedly mounted in partition 20 by being molded in, or glued in, or otherwise fixed in place. Common metal connector member 21 has a pair of bullet-shaped or conically-shaped projections 22 and 23, respectively, which project into connection chambers 16 and 17.

A pair of non-conductive second coupling members 30 and 31 having externally threaded walls 32, 33 and knurlated thumb and forefinger grasp members 34, 35, respectively. The externally threaded walls 32 and 33 are threadably engaged with internally threaded bores 18 and 19, respectively. Each of the non-conductive second coupling members 30 and 31 has a throughbore 36, 37, respectively, with an inwardly projecting member 38, 39. A first conical surface 40, 41 has an apex end 42, 43 constituting the narrowest portion of the throughbore The conical surfaces 40, 41 serve the function of guiding the loose wire strands to the apex end and thence upon the bullet ends 22, 23 of metal connector member 21. The opposite side of the apex end 43 includes a second conical surface 44, 45, respectively, which coact with the bullet- or conically-shaped ends 22, 23 to form a space into which the bare wire ends 11 and 12 are splayed and guided by the bullet-shaped ends 22 and 23 of connection member 21. The apex 42 prevents the insulation wires from being jammed into the space between the first and second conically-shaped surfaces. Thus, when the bare ends of the electrical wires are inserted into the second end of the throughbore in the second coupling members, the bare wire end is guided off the central axis by the bullet-shaped end surfaces to be positioned between and the spaced conically-shaped surfaces. When the user grasps the knurled ends 34, 35, and rotates them in a direction as to cause the coupling members 30 and 31 to move inwardly, the wire ends 11 and 12 are tightly gripped or clamped between the conically-shaped surfaces 44, 45 and the bullet-shaped ends, respectively. The wires 11 and 12 can be clamped simultaneously or separately.

Knurlations may also be formed on the housing member 15.

Figure 6:
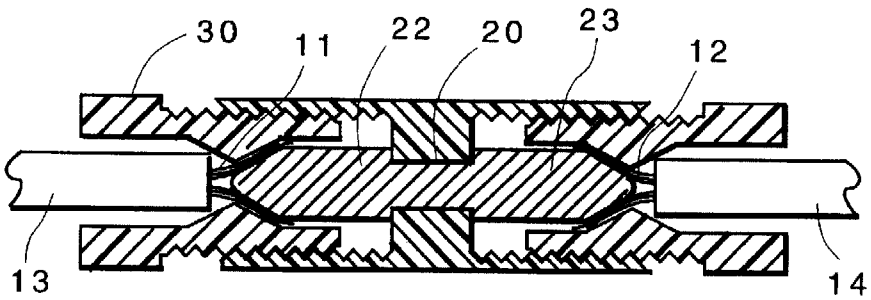
FIG. 6 is a sectional view showing the two wires as they are clamped in position in accordance with the invention.
Figure 5:
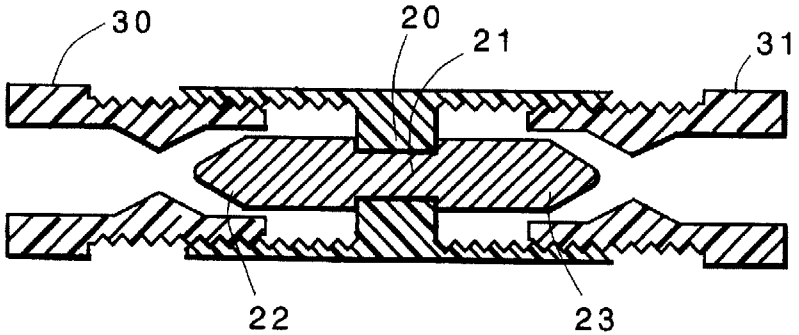
FIG. 5 shows the components of FIGS. 3 and 4 combined.
Figure 7B:
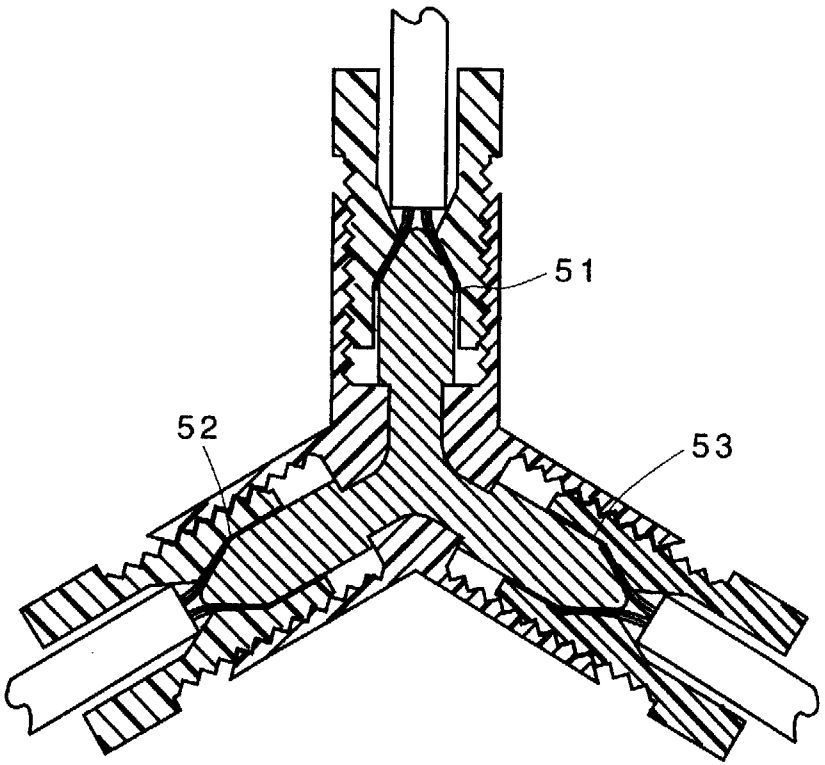
FIG. 7B is a sectional view of a three-wire connector with the wires connected.
Figure 7A:
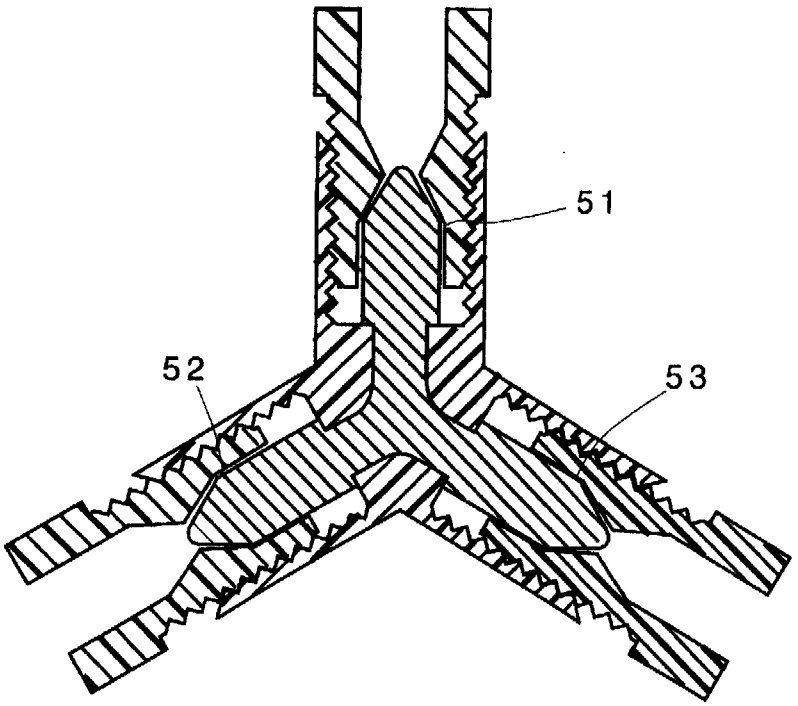
FIG. 7A is a sectional view showing a three-wire connector incorporating the invention.

FIG. 6 shows the bare wire ends clamped in position in accordance with the invention FIG. 7A is a sectional view showing a three-wire connector incorporating the invention. In this embodiment, the housing member is comprised of a Y-shaped member 50 having three connection chambers 51, 52 and 53 with correspondingly shaped conical surfaces and apex ends. FIG. 7B shows the unit with the three different wires secured in place. It will be appreciated that it is not necessary to use all three connections, and two may be used if that is all that is required.

Figure 8B:
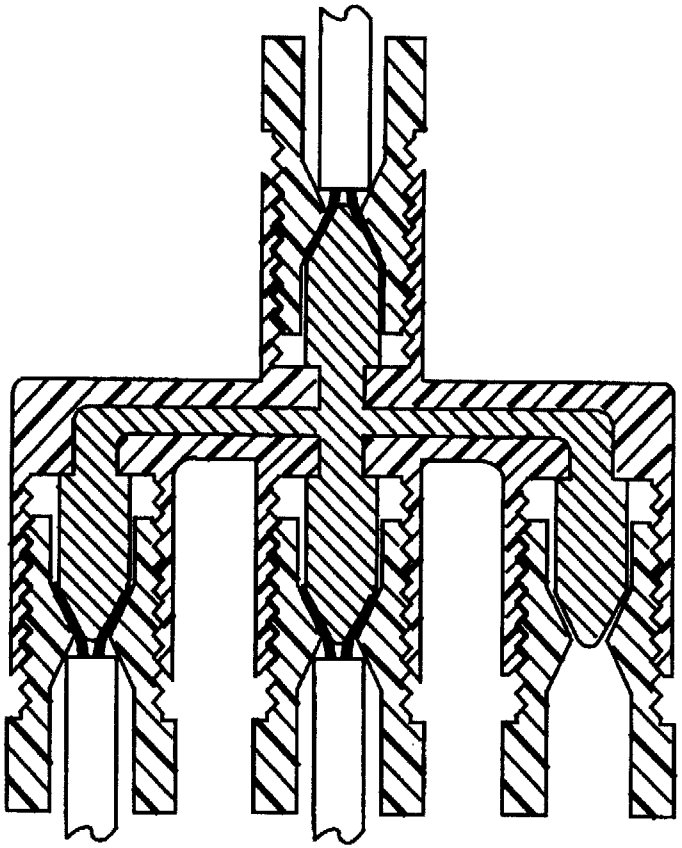
FIG. 8B is a sectional view of the four-wire connector with several wires connected.
Figure 8A:
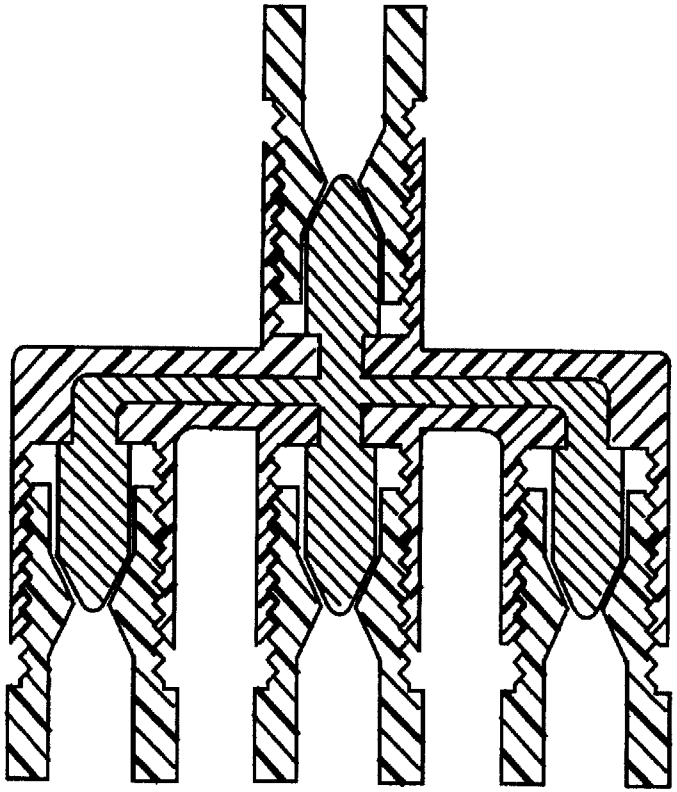
FIG. 8A is a sectional view showing a four-wire connector incorporating the invention.
Figure 9:
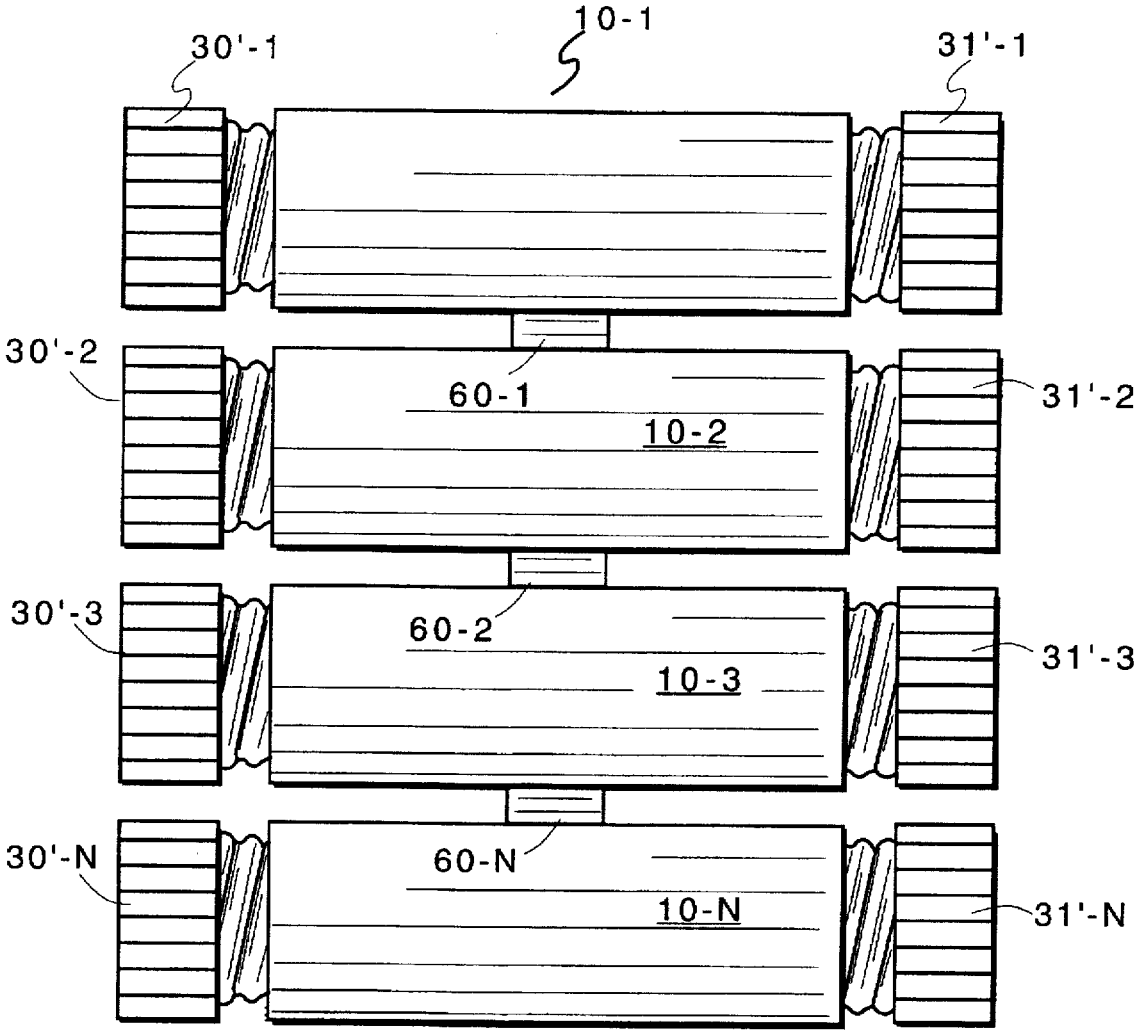
FIG. 9 is a top view of a further embodiment of the invention.

Similarly, FIG. 8A is a sectional view showing a four-wire connector incorporating the invention, and FIG. 8B is a sectional view of the four-wire connector with several wires connected. It will be appreciated that more or less connections may be made and that the unit may be made for five, six or seven units or more. In fact, it will be further appreciated that several units such as shown in FIGS. 1, 7 and 8 may be molded together and with assorted colors for different colored wires and associated wire sizes and/or with break-away tubs or connectors as shown in FIG. 9. In connection with wire size, it will be appreciated that the different units may be made for different size wire ranges with differing forms of insulation thereon. Moreover, the non-conductive coupling members may be color coded, if desired.

In FIG. 9, a plurality of connectors 10-1, 10-2, 10-3 . . . 10-N are interconnected by breakable tear tabs 60-1, 60-2 . . . 60-N for manufacturing, packaging and distribution purposes. The connectors shown in FIGS. 7 and 8 can also be connected with break-away tabs.

While a preferred embodiment of the invention has been illustrated and described along with several modifications and adaptations of the invention, it will be appreciated that other modifications, adaptations and changes will be apparent to those skilled in the art.

What is claimed is:

1. A quick connect electrical connector for connecting the bare ends of a pair of insulated flexible electrical wires comprising:

a non-conductive first coupling member, said non-conducting first coupling member having a plurality of connection chambers, each connection chamber having an annular internally threaded wall and a central axis, a common conductive connector member, said common conductive connector member being fixedly mounted in said non-conductive first coupling member, said common conductive connecting member having a plurality of bullet-shaped end surfaces with each of said end surfaces tapering inwardly to a tip and being positioned in one of said connection chambers, respectively, a corresponding plurality of non-conductive second coupling members, each non-conductive second coupling member having an externally threaded annular wall and an internal throughbore, said throughbore having first and second ends, the first end of each said throughbores having a first conically shaped annular wall surface, said first conically shaped surface and said bullet-shaped connector end surfaces being spaced a variable distance apart when said threaded surfaces are engaged, each said second end of said throughbore having a second conical surface having an apex end for guiding loose wire strands to said apex end, whereby when the bare end of one of said electrical wires is inserted into one of said second end throughbore in said second coupling members, respectively, each said wire end is guided to said apex end and splayed off the central axis by said bullet-shaped end surface to a position between said spaced conically-shaped surfaces and rotation of said first, second non-conductive coupling members relative to said first non-conductive coupling member causes said internal and external threads to reduce said distance and clamp said bare ends of said electrical wires between said first and second conically-shaped surfaces in each said connection chamber, respectively.

2. A connector for splicing the free ends of two or more flexible electrical wires comprising:

a non-conductive body member having at least a pair of connection chambers, each connection chamber having a threaded bore, respectively, a common integral conductive member, said common integral conductive member having (1) at least a pair of rounded tip protrusions, one rounded tip protrusion extending into one connection chamber, respectively, and (2) a central portion fixedly secured in said non-conductive body member, at least a pair of hollow non-conductive male members, each hollow non-conductive male member having an inner surface shaped complementary to the shape of said rounded tip protrusions, and a threaded external surface portion for threaded engagement with said threaded bore, respectively, whereby the respective free ends of said two or more flexible wires can be received in said connection chambers, respectively, and each of said at least a pair of hollow non-conductive male members threadedly engaged with said threaded bores clampingly engage said ends of said two or more flexible electrical wires between said complementary shaped surfaces and said rounded tips, respectively, which said hollow non-conductive male members are axially moved relative to said body member.

3. The connector defined in claim 2 wherein said connection chambers are coaxial.

4. A plurality of connectors as defined in claim 2 and tear tab means between each non-conductive body member.

5. The connector defined in claim 2 wherein said connection chambers are not coaxial.

6. The connector defined in claim 5 wherein there are at least three connection chambers.

* * * * *